US011211194B2

(12) United States Patent
Kwon et al.

(10) Patent No.: US 11,211,194 B2
(45) Date of Patent: Dec. 28, 2021

(54) COIL ELECTRONIC COMPONENT

(71) Applicant: SAMSUNG ELECTRO-MECHANICS CO., LTD., Suwon-Si (KR)

(72) Inventors: Sang Kyun Kwon, Suwon-Si (KR); Han Wool Ryu, Suwon-Si (KR); Young Il Lee, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 608 days.

(21) Appl. No.: 16/008,847

(22) Filed: Jun. 14, 2018

(65) Prior Publication Data

US 2019/0115146 A1 Apr. 18, 2019

(30) Foreign Application Priority Data

Oct. 16, 2017 (KR) ..... 10-2017-0133905

(51) Int. Cl.

| | |
|---|---|
| ***H01F 27/32*** | (2006.01) |
| ***H01F 17/00*** | (2006.01) |
| ***H01F 27/28*** | (2006.01) |
| ***H01F 27/29*** | (2006.01) |
| ***H01F 1/147*** | (2006.01) |
| ***H01F 41/04*** | (2006.01) |
| ***H01F 41/12*** | (2006.01) |
| ***H01F 27/24*** | (2006.01) |
| ***H01F 17/04*** | (2006.01) |

(52) U.S. Cl.

CPC ..... *H01F 27/323* (2013.01); *H01F 1/147* (2013.01); *H01F 17/0013* (2013.01); *H01F 17/04* (2013.01); *H01F 27/24* (2013.01); *H01F 27/2804* (2013.01); *H01F 27/29* (2013.01); *H01F 27/292* (2013.01); *H01F 27/324* (2013.01); *H01F 41/041* (2013.01); *H01F 41/122* (2013.01); *H01F 2017/048* (2013.01); *H01F 2027/2809* (2013.01)

(58) Field of Classification Search

CPC . H01F 17/0013; H01F 27/2804; H01F 27/323
See application file for complete search history.

(56) References Cited

U.S. PATENT DOCUMENTS

2009/0003191 A1* 1/2009 Inuzuka ..... H01F 17/0013 369/283
2012/0268230 A1* 10/2012 Kim ..... H01F 17/04 336/200

(Continued)

FOREIGN PATENT DOCUMENTS

KR 10-2015-0105088 A 9/2015
KR 10-2016-0108927 A 9/2016

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil electronic component includes a body having a coil portion embedded therein, and external electrodes connected to the coil portion, wherein the body includes a plurality of magnetic portions having a form in which magnetic particles are dispersed in an insulator and one or more insulating portions disposed between the plurality of magnetic portions.

19 Claims, 5 Drawing Sheets

I-I'

(56) References Cited

U.S. PATENT DOCUMENTS

| | | | | |
|---|---|---|---|---|
| 2013/0002389 | A1* | 1/2013 | Son | H01F 3/14 336/200 |
| 2013/0069752 | A1* | 3/2013 | Kim | H01F 3/14 336/200 |
| 2014/0266543 | A1* | 9/2014 | Park | H01F 17/04 336/200 |
| 2015/0255206 | A1 | 9/2015 | Han et al. | |
| 2016/0180995 | A1* | 6/2016 | Park | H01F 17/0013 336/233 |
| 2016/0181002 | A1* | 6/2016 | Kim | H01F 17/0013 336/200 |
| 2016/0268040 | A1 | 9/2016 | Kim et al. | |
| 2016/0293316 | A1* | 10/2016 | Park | H01F 17/0013 |
| 2017/0256353 | A1* | 9/2017 | Park | H01F 17/04 |
| 2018/0204902 | A1* | 7/2018 | Huang | H01L 23/645 |
| 2018/0308612 | A1* | 10/2018 | Park | H01F 5/04 |
| 2018/0323158 | A1* | 11/2018 | Deligianni | H01L 23/5227 |
| 2018/0366246 | A1* | 12/2018 | Park | H01F 27/29 |
| 2019/0035523 | A1* | 1/2019 | Kou | B32B 27/08 |

* cited by examiner

I-I'

A

I-I'

COIL ELECTRONIC COMPONENT

CROSS-REFERENCE TO RELATED APPLICATION(S)

This application claims the benefit of priority to Korean Patent Application No. 10-2017-0133905 filed on Oct. 16, 2017, in the Korean Intellectual Property Office, the disclosure of which is incorporated herein by reference in its entirety.

TECHNICAL FIELD

The present disclosure relates to a coil electronic component.

BACKGROUND

In accordance with miniaturization and thinning of electronic devices such as a digital television (TV), a mobile phone, a laptop computer, and the like, miniaturization and thinning of coil electronic components used in such electronic devices have been demanded. In order to satisfy such demand, research and development of various winding type or thin film type coil electronic components have been actively conducted.

Amain issue depending on the miniaturization and thinning of the coil electronic component is to implement characteristics equal to characteristics of an existing coil electronic component in spite of the miniaturization and thinning. In order to satisfy such demand, a ratio of a magnetic material should be increased in a core in which the magnetic material is filled. However, there is a limitation in increasing the ratio due to a change in strength of a body of an inductor, frequency characteristics depending on insulation properties of the body, and the like.

As an example of a method of manufacturing the coil electronic component, a method of implementing the body by stacking and then pressing sheets in which magnetic particles, a resin, and the like, are mixed with each other on coils has been used, and ferrite, a metal, or the like, may be used as the magnetic particles. When metal magnetic particles are used, it is advantageous in terms of characteristics such as a magnetic permeability, or the like, of the coil electronic component to increase a content of the metal magnetic particles. However, in this case, insulation properties of the body are deteriorated, such that breakdown voltage characteristics of the coil electronic component may be deteriorated.

SUMMARY

An aspect of the present disclosure may provide a coil electronic component of which breakdown voltage characteristics are improved by improving an insulation property of a body. Such a coil electronic component may have improved magnetic characteristics due to the improvement of the insulation properties of the body and may be advantageous in miniaturization.

According to an aspect of the present disclosure, a coil electronic component may include: a body having a coil portion embedded therein; and external electrodes connected to the coil portion, wherein the body includes a plurality of magnetic portions having a form in which magnetic particles are dispersed in an insulator and one or more insulating portions disposed between the plurality of magnetic portions.

The insulating portion may be coated on one surface of the magnetic portion.

The insulating portion may be an atomic layer deposition (ALD) layer.

The insulating portion may be formed of alumina.

The insulating portion may have a thickness of 100 nm or less.

The coil portion may have a magnetic core formed in a center thereof.

The insulating portion may be depressed toward the magnetic core.

The insulating portion may be in contact with coil patterns included in the coil portion.

The coil portion may include coating layers formed on surfaces of coil patterns included in the coil portion, and the insulating portion may be in contact with the coating layers.

The insulator may be an insulating resin.

The magnetic particle may be formed of an Fe-based alloy.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
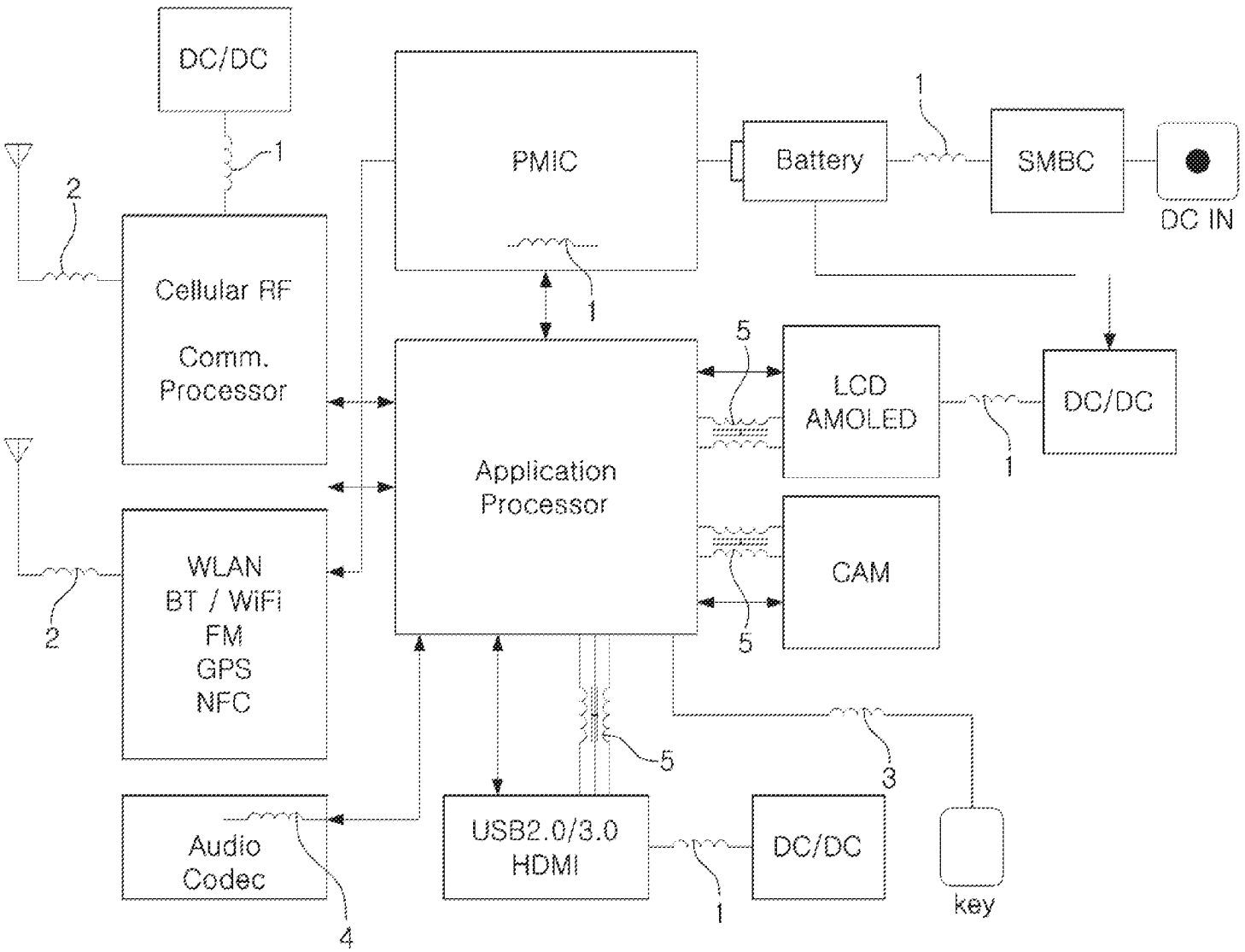
FIG. 1 is a schematic view illustrating an example of a coil electronic component used in an electronic device.

Hereinafter, exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

Electronic Device

FIG. 1 is a schematic view illustrating an example of a coil electronic component used in an electronic device.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. In this case, various kinds of coil electronic components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or the like. The electronic device may also be various other electronic devices well-known in those skilled in the art, in addition to the devices described above.

Coil Electronic Component

Hereinafter, a coil electronic component according to the present disclosure, particularly, an inductor will be described for convenience of explanation. However, the coil electronic component according to the present disclosure may also be used as the coil electronic components for various purposes as described above.

Figure 2:
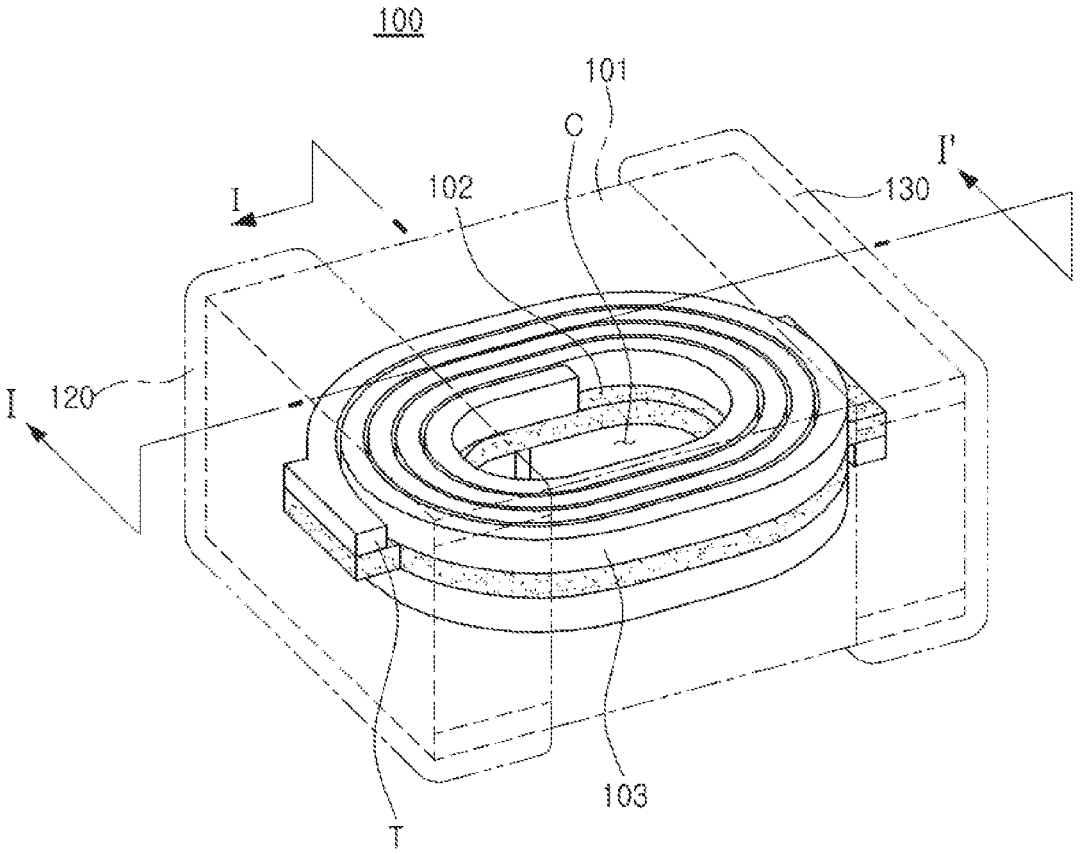
FIG. 2 is a schematic perspective view illustrating a coil electronic component according to an exemplary embodiment in the present disclosure.
Figure 3:
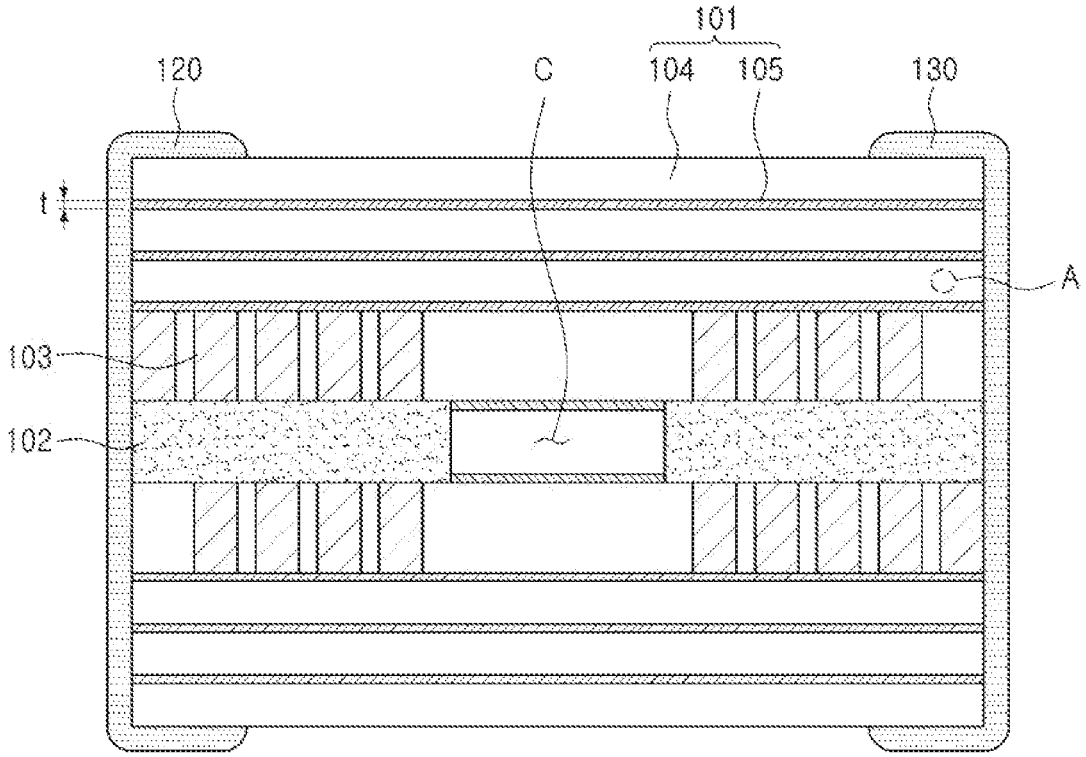
FIG. 3 is a schematic cross-sectional view taken along line I-I' of the coil electronic component of FIG. 2.
Figure 4:
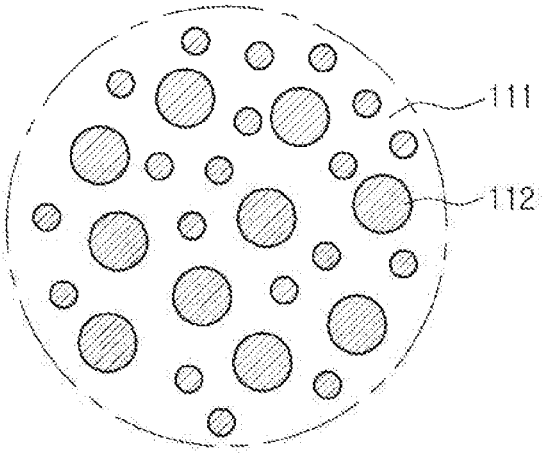
FIG. 4 is an enlarged view of region A of FIG. 3.

FIG. 2 is a schematic perspective view illustrating an appearance of a coil electronic component according to an exemplary embodiment in the present disclosure. FIG. 3 is a cross-sectional view taken along line I-I' of FIG. 1. In addition, FIG. 4 is an enlarged view of region A of FIG. 3.

A coil electronic component 100 according to an exemplary embodiment in the present disclosure may include a body 101, a coil portion 103, and external electrodes 120 and 130. As illustrated in FIG. 3, the body 101 may include a plurality of magnetic portions 104 and insulating portions 105 disposed between the plurality of magnetic portions 104. The coil portion 103 may be embedded in the body 101. In this case, a support member 102 supporting the coil portion 103 may be disposed in the body 101.

The coil portion 103 may perform various functions in the electronic device through characteristics appearing from a coil of the coil electronic component 100. For example, the coil electronic component 100 may be a power inductor. In this case, the coil portion 103 may serve to store electricity in a magnetic field form to maintain an output voltage, resulting in stabilization of power. In this case, coil patterns constituting the coil portion 103 may be stacked on opposite surfaces of the support member 102, respectively, and may be electrically connected to each other through a conductive via (not shown) penetrating through the support member 102. The coil portion 103 may have a spiral shape, and include lead portions T formed at the outermost portions of the spiral shape. The lead portions T may be exposed to the outside of the body 101 for the purpose of electrical connection to the external electrodes 120 and 130. In addition, the coil portion 103 may include a magnetic core C formed at the center thereof. The magnetic core C may constitute a portion of the body 101.

The coil patterns constituting the coil portion 103 may be formed by a suitable plating process, such as a pattern plating process, an anisotropic plating process, an isotropic plating process, or the like, and may also be formed in a multilayer structure by a plurality of processes of these processes.

The support member 102 supporting the coil portion 103 may be formed of a suitable polymer, such as e.g., a polypropylene glycol (PPG) substrate, or a ferrite substrate, a metal based soft magnetic substrate, or the like.

The external electrodes 120 and 130 may be formed on outer surfaces of the body 101, and may be connected to the lead portions T, respectively. The external electrodes 120 and 130 may be formed of a paste including a metal having excellent electrical conductivity, such as a conductive paste including nickel (Ni), copper (Cu), tin (Sn), or silver (Ag), or alloys thereof. In addition, plating layers (not illustrated) may further be formed on the external electrodes 120 and 130. In this case, the plating layers may include one or more selected from the group consisting of nickel (Ni), copper (Cu), and tin (Sn). For example, nickel (Ni) layers and tin (Sn) layers may be sequentially formed in the plating layers.

In the present exemplar embodiment, the body 101 may have a multilayer structure, and the insulating portions 105 may be disposed between the plurality of magnetic portions 104 having magnetic particles 112 to enhance insulation properties of the body 101. Referring to FIG. 4, each of the plurality of magnetic portions 104 may have a form in which the magnetic particles 112 are dispersed in an insulator 111. As the insulator 111, an insulating resin such as an epoxy resin may be used. The magnetic particles 112 may be formed of a conductive material having a magnetic property, such as a metal. An example of such a material may include an Fe-based alloy. In detail, the magnetic particles 112 may be formed of a nano crystal grain based alloy having an Fe—Si—B—Nb—Cr composition, an Fe—Ni-based alloy, or the like. The magnetic particles may include magnetic particles of two sizes, a first particle size being in a range from about 10 μm to about 50 μm, and a second particle size being in a range from about 0.5 μm to about 3 μm. When the magnetic particles 112 are implemented using the Fe-based alloy as described above, magnetic characteristics of the body 101, such as a magnetic permeability, and the like, may be excellent, but the body 101 is vulnerable to electrostatic discharge (ESD), and an appropriate insulating structure for the magnetic particles 112 may thus be required. That is, when the insulation properties of the body 101 is deteriorated, breakdown voltage characteristics of the coil electronic component may be deteriorated, such that an electrical conduction path between the magnetic particles 112 or between the magnetic particles 112 and the coil portion 103 may be formed, resulting in deterioration of characteristics such as a decrease in an inductance of the inductor, or the like.

In the present exemplary embodiment, the insulating portions 105 that may perform an additional insulation function may be disposed between the plurality of magnetic portions 104. The insulating portion 105 may be coated on one surface of the magnetic portion 104. The insulating portion 105 may be an atomic layer deposition (ALD) layer. Therefore, an insulation property may be enhanced, and an increase in a thickness of the body 101 may be significantly suppressed. ALD may be a process capable of performing very uniform coating on a surface of a target object at a level of an atomic layer by a surface chemical reaction in a process of periodically supplying and discharging a reactant, and the insulating portion 105 obtained by the ALD may have a small thickness and have an excellent insulation property. Therefore, even in a case in which a large amount of magnetic particles 112 are filled in the magnetic portions 104, the insulation properties of the body 101 may be secured. The insulating portion 105 may be formed of ceramic such as alumina ($Al_2O_3$), silica ($SiO_2$), or the like. In addition, the insulating portion 105 may be formed at a relatively small thickness, which is advantageous in miniaturization of the body 101, and a thickness t of the insulating portion 105 may be about 100 nm or less.

As illustrated in FIG. 3, the insulating portion 105 may be in contact with the coil patterns included in the coil portion 103, and an insulation property between the coil portion 103 and the magnetic particles 112 may thus be improved. A contact structure between the insulating portion 105 and the coil portion 103 may be obtained by stacking the insulating portion 105 on the coil portion 103 in a state in which the insulating portion 105 is coated on one surface of the magnetic portion 104, as described below in a manufacturing process.

Figure 5:
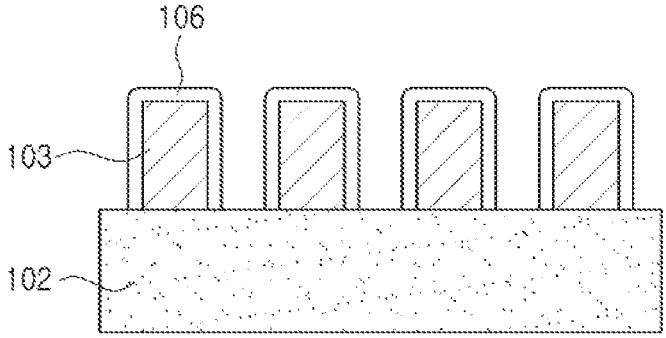
FIG. 5 is a view illustrating a form of a coil portion according to a modified example.

Meanwhile, as in a modified example of FIG. 5, coating layers 106 may be formed on surfaces of the coil patterns constituting the coil portion 103 in order to further improve an insulation property. The coating layer 106 may be formed of an oxide film, or the like. In this case, the insulating portion 105 is not in directly contact with the coil portion 103, but may be in contact with the coating layer 106.

Figure 6:
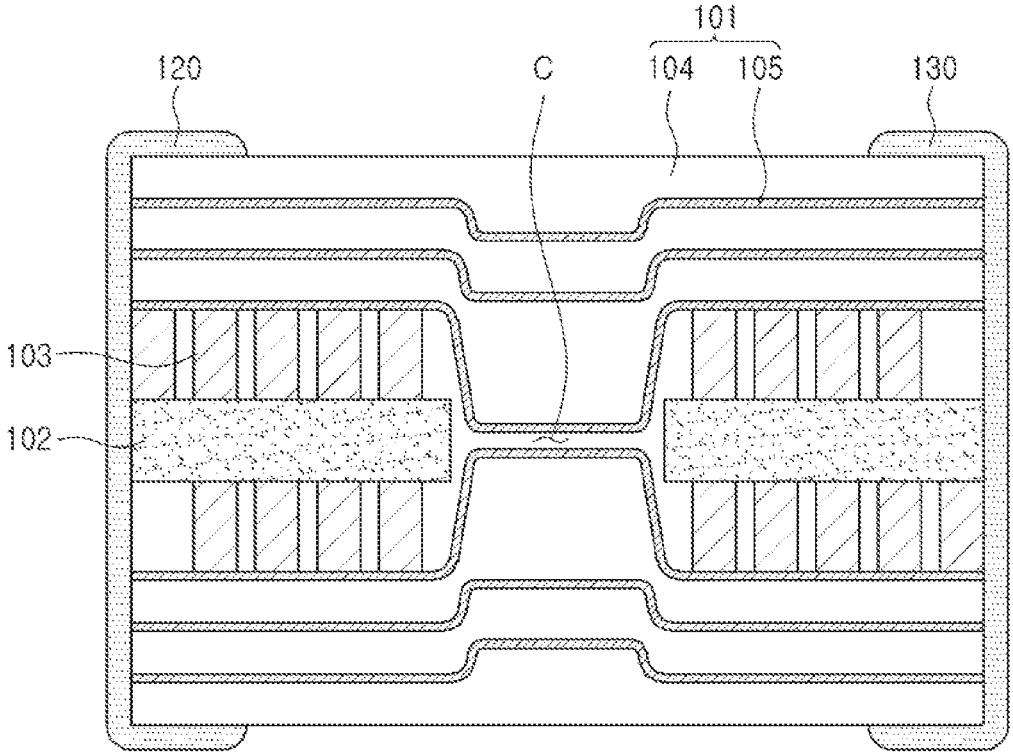
FIG. 6 is a schematic cross-sectional view illustrating a coil electronic component according to a modified embodiment.

FIG. 6 is a view illustrating a coil electronic component according to another modified example, which is different in a form of a body 101 from the coil electronic component according to the above-mentioned exemplary embodiment. In the present modified example, insulating portions 105 may be implemented to be depressed toward the magnetic core C. When a process of stacking the insulating portion 105 on the coil portion 103 in a state in which the insulating portion 105 is coated on one surface of the magnetic portion 104 is used, the insulating portion 105 may be naturally bent toward the center in the magnetic core C in which the coil portion 103 does not exist.

Figure 7:
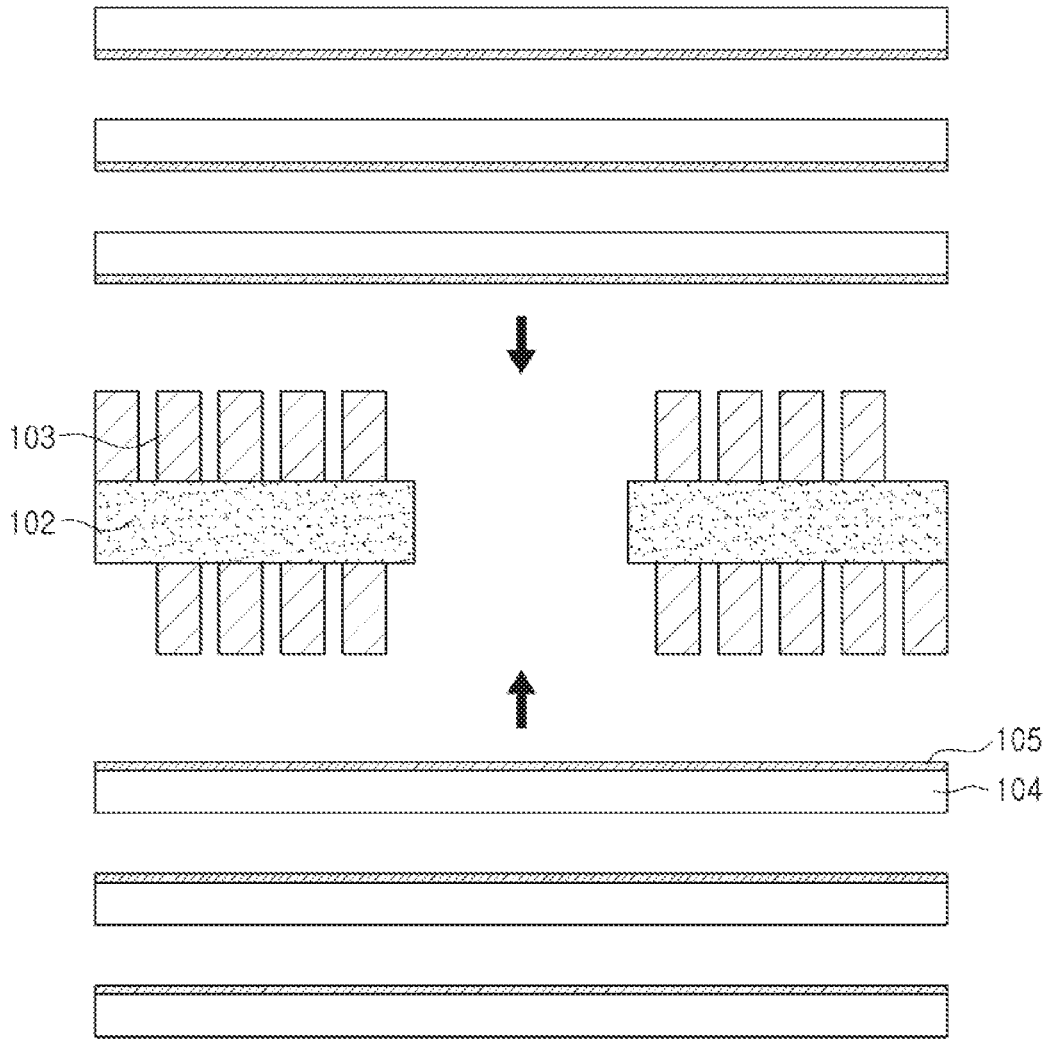
FIG. 7 is a view illustrating a method of manufacturing a coil electronic component according to an exemplary embodiment in the present disclosure.

FIG. 7 is a view illustrating a method of manufacturing a coil electronic component according to an exemplary embodiment in the present disclosure. As illustrated in FIG. 7, in the coil electronic component having the structure described above, the body may be formed by a stacking process. First, the coil portion 103 may be formed on the support member 102 by a method such as plating, or the like. Then, a unit laminate for manufacturing the body may be formed. The unit laminate may include the magnetic portion 104 and the insulating portion 105. The magnetic portion 104 may be manufactured in a sheet shape by mixing metal magnetic particles, a thermosetting resin, and organic materials such as a binder, a solvent, and the like, with one another to prepare slurry and applying and then drying the slurry at a thickness of several ten micrometers on a carrier film by a doctor blade method. The magnetic particles may include magnetic particles of two sizes, a first particle size being in a range from about 10 μm to about 50 μm, and a second particle size being in a range from about 0.5 μm to about 3 μm. Therefore, the magnetic portion 104 may be manufactured in a form in which the magnetic particles are dispersed in the thermosetting resin such as an epoxy resin, a polyimide resin, or the like. In addition, the insulating portion 105 may be formed on a surface of the magnetic portion 104 by an ALD process using a material such as alumina, or the like.

A plurality of unit laminates may be formed in such a manner, and may be stacked, compressed, and hardened to implement the body, as illustrated in FIG. 7. In this case, an additional insulating layer may be disposed at a position adjacent to the coil portion 103, and may be stacked together with the unit laminates. The additional insulating layer may not separately include the insulating portion 105.

As set forth above, in the coil electronic component according to the exemplary embodiment in the present disclosure, the insulation properties of the body may be improved, such that breakdown voltage characteristics of the coil electronic component may be improved, and the insulating portions having a small size may be used, which is appropriate for the miniaturization of the body portion.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body having a coil portion embedded therein, the coil portion having a magnetic core; and external electrodes connected to the coil portion, wherein the body includes a plurality of magnetic portions having a form in which magnetic particles are dispersed in an insulator and an insulating portion disposed between the plurality of magnetic portions, and between the coil portion and the plurality of magnetic portions, wherein the insulating portion is depressed toward the magnetic core.

2. The coil electronic component of claim 1, wherein the insulating portion is coated on one surface of the magnetic portion.

3. The coil electronic component of claim 2, wherein the insulating portion is an atomic layer deposition (ALD) layer.

4. The coil electronic component of claim 1, wherein the insulating portion comprises alumina.

5. The coil electronic component of claim 1, wherein the insulating portion has a thickness of 100 nm or less.

6. The coil electronic component of claim 1, wherein the coil portion has a magnetic core formed in a center thereof.

7. The coil electronic component of claim 1, wherein the insulating portion is in contact with coil patterns included in the coil portion.

8. The coil electronic component of claim 1, wherein the coil portion includes coating layers formed on surfaces of coil patterns included in the coil portion, and the insulating portion is in contact with the coating layers.

9. The coil electronic component of claim 1, wherein the insulator is an insulating resin.

10. The coil electronic component of claim 1, wherein the magnetic particle is formed of an Fe-based alloy.

11. A coil electronic component, comprising:

a body comprising magnetic portions and insulating portions disposed between adjacent magnetic portions, the magnetic portions comprising magnetic particles dispersed in an insulator;

a coil portion embedded in the body; and external electrodes connected to the coil portion and provided on an external surface of the body, wherein the coil portion has a magnetic core at a center thereof and the insulating portions are depressed toward the magnetic core.

12. The coil electronic component of claim 11, wherein the insulating portion has a thickness of less than 100 nm and is disposed conformally on a corresponding magnetic portion.

13. The coil electronic component of claim 11, wherein the insulating portion comprises a ceramic.

14. The coil electronic component of claim 11, wherein the insulator comprises a resin.

15. The coil electronic component of claim 11, wherein the magnetic particles comprise a Fe-based alloy.

16. The coil electronic component of claim 11, wherein the external electrodes comprise a conductive paste disposed on an external surface of the body.

17. A coil electronic component, comprising:

a body comprising a plurality of laminates, each laminate comprising a magnetic layer and an insulating layer disposed on the magnetic layer, the laminates being disposed such that the insulating layer and the magnetic layer are alternately stacked;

a coil portion embedded in the body and having a magnetic core; and external electrodes disposed on external surfaces of the body and electrically in contact with corresponding ends of the coil portion, wherein the insulating layer of the laminate comprises a ceramic conformally formed on the corresponding magnetic layer, wherein the insulating layer is depressed toward the magnetic core.

18. The coil electronic component of claim 17, wherein magnetic layer of the laminate comprises magnetic particles dispersed in an insulating material.

19. The coil electronic component of claim 17, wherein the insulating layer of the laminate has a thickness of less than 100 nm.

* * * * *